US007788743B2

(12) United States Patent
Mjelde et al.

(10) Patent No.: US 7,788,743 B2
(45) Date of Patent: Sep. 7, 2010

(54) DRAIN COVER

(76) Inventors: Olaf W. Mjelde, 1666 Garnet Ave., #224, San Diego, CA (US) 92109; Wade H. Arens, Jr., 19 Sembrado, Rancho Santa Margarita, CA (US) 92688

( * ) Notice: Subject to any disclaimer, the term of this patent is extended or adjusted under 35 U.S.C. 154(b) by 851 days.

(21) Appl. No.: 11/096,689

(22) Filed: Mar. 31, 2005

(65) Prior Publication Data

US 2006/0218714 A1 Oct. 5, 2006

(51) Int. Cl.
*E04H 4/00* (2006.01)

(52) U.S. Cl. ..... 4/507; 4/286

(58) Field of Classification Search ..... 4/507, 4/652, 286–293; 138/96 R
See application file for complete search history.

(56) References Cited

U.S. PATENT DOCUMENTS

| | | | | |
|---|---|---|---|---|
| 3,378,858 | A | 4/1968 | Jacuzzi | |
| 4,429,832 | A | 2/1984 | Sheets | |
| 4,844,403 | A | 7/1989 | Castle | |
| 5,427,417 | A | 6/1995 | Lechuga | |
| 5,860,173 | A | 1/1999 | Herring | |
| 6,209,586 | B1 | 4/2001 | Wright | |
| 6,314,590 | B1 * | 11/2001 | Lee | 4/286 |
| 6,340,035 | B2 | 1/2002 | Wright | |
| 6,557,588 | B2 | 5/2003 | Wright | |
| 6,643,857 | B1 | 11/2003 | Kenna et al. | |
| 2002/0192028 | A1 | 12/2002 | Carston | |
| 2004/0144328 | A1 | 7/2004 | Bonner et al. | |

FOREIGN PATENT DOCUMENTS

| | | | |
|---|---|---|---|
| GB | 2431101 A | * | 4/2007 |
| JP | 405098655 | | 4/1993 |
| JP | 02000355964 | | 12/2000 |

* cited by examiner

*Primary Examiner*—Tuan N Nguyen
(74) *Attorney, Agent, or Firm*—Robert Lauson; Lauson & Tarver, LLP

(57) ABSTRACT

A drain cover adapted for engagement in a cavity above the drain aperture in the surface forming a pool or spa and below a top component. The top component features a substantially transparent center section which provides a view of a display component housed in a display cavity formed between the drain aperture and the center section of the top component. The display component is easily changed by removal of the top component, replacing the display component, and remounting the top component.

19 Claims, 4 Drawing Sheets

DRAIN COVER

FIELD OF THE INVENTION

The invention herein disclosed relates to drains for pools, ponds, and spas. More particularly it relates to a device and method for providing a drain with a transparent or opaque top surface cover which may be configurable by the user to match the surface of material adjacent to the drain which it covers through insertion of matching material behind the transparent cover. The device and method herein disclosed also provide for such a drain cover that is customizable by the user to display any photo, indicia, or other material which can be placed behind the top surface cover. The device thereby enables users of pools, spas, or ponds to disguise the drain by placing material that is the same or appears similar to material forming the adjacent wall surface. This is accomplished by placing the matching material inside the cavity behind the substantially transparent top surface cover. The material can be the same forming the interior surface of the pool or spa, or it can be a print or photograph appearing the same as the adjacent spa or pool surface. It could also be a photo, print, drawing, or other indicia or artwork that the user wishes to display. The displayed component or surface would be placed into the cavity adjacent to the transparent top surface of the cover by removing the top cover and placing whatever is to be displayed through the top surface inside the cavity behind it. This would be especially useful in displaying hotel logos, advertisements, photographs, or the like which must be protected from sunlight and abrasion by the top surface but which still can be changed as needed or desired.

BACKGROUND OF THE INVENTION

Conventional pools, spas, ponds, and similar artificial water holders are conventionally formed with a drain opening on their bottoms at the lowest point on the bottom surface. Generally, these drain openings communicate through the cement or gunite or other material forming the pool or spa and connect the interior of the pool or spa with an underlying conduit into which water may be drained or is communicated to the filtration system to keep the water clean. Typically water communicated through the drain opening will be pumped through a filter and back into the pool or spa through return lines which communicate therein.

Pool and spa owners can spend thousands if not hundreds of thousands of dollars on the construction of their pool or spa. A large amount of that cost is designing and constructing an aesthetically pleasing bottom and side surface which will feature a specific color, design, pattern, or other design elements to make the pool or spa attractive.

Further, the constant circulation of water through the drain opening or openings in the bottom of the pool or spa tends to create a suctional vortex adjacent to these drains. In order to prevent injury or worse yet, drowning, the drains are conventionally overlaid with a cover that helps to eliminate this vortex action.

Unfortunately, most such covers tend to be utilitarian and not pleasing to the eye. They are constructed of plastic and when an owner has spent huge amounts of money on an eye-pleasing surface for the bottom and sides forming the pool or spa, the placement of one or a plurality of white or non-matching pool drain covers dot the bottom of the expensive pool surface. To address these problems, various anti-vortex drains and covers have been developed which feature water flow characteristics that also tend to reduce the suction around the drains while concurrently having an appearance that helps enhance the aesthetic appeal of the pool or spa.

A conventional drain cover widely employed for most swimming pools and many spas and required by building codes in many areas is a circular shaped anti-vortex drain cover. This type of cover is adapted to be positioned above a substantially circular drain opening leaving a gap on side perimeter edges for water flow from the pool and into the underlying drain. Such covers are generally formed of plastic material that is resistant to chlorine as well as sunlight and are generally available only in a limited number of colors such as black, white, and shades of gray or colors which will stand up to the chlorine and sunlight rich environment.

Because of manufacturing considerations and the environment in which they must operate, the materials forming standard drain covers frequently do not match the surface finish of the swimming pool or spa adjacent to the drain opening. As noted above such surfaces are installed in a wide variety of textures and colors which are custom made for the individual owner at great expense in time and labor.

Consequently, because of the great attention to color and texture of the surfacing forming the walls of the pool or spa, the conventionally available drain covers will appear conspicuously out of place when installed over the drain and surrounded by the custom surface finishing of swimming pools or spas. For the same reason, conventionally available drain covers will appear unaesthetic and out of place when employed to cover drain openings formed on the bottom of spas that are decorated with a colored fiberglass, plaster or exposed aggregate finish.

In an attempt to remedy the problem, cover manufacturers have attempted to manufacture covers that do not stick out like a sore thumb. Some covers are made from neutral colored plastic and others have been made of opaque plastic in attempts to blend in with the surroundings. Unfortunately neutral colors still appear out of place on a custom pool or spa surface and a transparent or opaque cover appears as a dark shadow or black dot at the bottom of the pool since the underlying drain is below and void of reflective color.

Other covers have been manufactured that allow for the surfacing used at the time of construction to be adhered to the top surface of the cover itself. However, these covers suffer from cracking of the adhered surface due to flexing of the plastic cover over time or from pool users such as children pushing off or otherwise striking the plastic cover. Further, since the matching material is placed on top of the plastic cover, it is continually exposed to UV and other sunlight which will damage most materials in the long run, especially printed materials which will fade.

U.S. Pat. No. 6,209,586 (Wright) teaches a drain cover that is engageable over a drain opening that provides an overriding top surface that allows the user to adhere surface material thereon to match the surrounding surface. However, Wright's device can allow cracking of the adhered material due to differing expansion characteristics. The adhered material is exposed directly to the pool or spa risking abrasion and chipping from users or objects. Also, flexing of this cover can cause cracking and chipping. Further the Wright device requires an entirely new cover to change the displayed design, and if broken, it is a problem to match years old surfacing with newly adhered surface to a replacement.

U.S. Pat. No. 3,378,758 (Jacuzzi) discloses an anti-vortex cover; however, Jacuzzi makes no allowance to match adjacent surfacing material.

U.S. Pat. No. 6,340,035 (Wright) is another example of a drain cover that provides for adhesion of surfacing to the exterior of the cover in a matching attempt. However, this Wright patent provides no protection to the surface itself, is prone to flexing, and requires replacement of the entire cover to change the displayed color or material over the drain.

As such, there is an ongoing need for a drain cover which is engageable over the drain opening in the bottom of a pool or spa and which is user configurable to match the surrounding surface. Such a device should allow for the use of portions of the surrounding surface itself or photographic representations thereof. Such a device should provide protection to the matching or displayed surface to be viewed from above the pool so that is does not crack or chip or fade and is protected from objects or people striking it. Still further, such a device should allow the user to display virtually any indicia or design or color that can be engaged behind the top surface cover and to easily change the displayed surface as needed or desired.

With respect to the above description, before explaining at least one preferred embodiment of the invention in detail, it is to be understood that the invention is not limited in its application to the details of construction and to the arrangement of the components or steps set forth in the following description or illustrated in the drawings. The various apparatus and methods of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

Therefore, those skilled in the art will appreciate that the conception upon which this disclosure is based may readily be utilized as a basis for designing of other devices, methods and systems for carrying out the several purposes of the present disclosed device. It is important, therefore, that the objects and claims be regarded as including such equivalent construction and methodology insofar as they do not depart from the spirit and scope of the present invention.

Further objectives of this invention will be brought out in the following part of the specification wherein detailed description is for the purpose of fully disclosing the invention without placing limitations thereon.

SUMMARY OF THE INVENTION

The device herein disclosed and described provides an anti-vortex drain cover which when viewed from above the water's surface will provide viewing of a display component that is housed in a cavity behind a transparent top surface cover. The display component is thereby protected from abrasion from occupants of the pool or spa or from the cleaning implements such as automatic pool cleaners, brooms, brushes, and scrapers.

In providing a drain cover formed of a plurality of engaged components, the cavity adjacent to the top provides a housing for the display component and allows for the display component to be easily inserted and changed as needed. The component engaged in the cavity behind the top surface cover is viewed from above the water's surface and depicts whatever the user chooses to engage in the cavity.

The drain cover will thus blend in and be virtually indistinguishable from the surrounding surface of the pool or spa if the display component is formed of the same material as the surrounding surface during construction. Or, the display component may be printed using waterproofed ink that is substantially the same color as the surrounding surface thus providing the ability for the drain to disappear or blend into the surroundings.

Additionally, the device allows the user to place an infinite number of different types of display components into the protected cavity formed behind the transparent top cover of the drain cover. The displayed component need only be sized to fit into the cavity and remain in registered engagement therein. This can be accomplished by using a tray or by simply adhering the display component to the underlying drain component forming the bottom wall of the cavity behind the top cover of the drain cover.

The provision of such a cavity to house and protect the display component provides the user great utility in that they can place the same aggregate or colored plaster or cement or fiberglass material that forms the surrounding surface and make the drain virtually disappear when viewed from above the water line. Or, just the opposite can be accomplished by placing printed matter, logos, photos, or other indicia or advertisements inside the cavity where they can easily be seen from above the water line through the transparent top cover. As an example a hotel might wish to display the hotel logo identifying the hotel where the pool is located from the cavity, or a homeowner might wish to place a photograph of a child to be viewed through the top cover. As long as the displayed component is resistant to water and is sized for operative engagement inside the cavity, there is no limit to what can be displayed.

Further, once the display component is housed inside the cavity and the drain top cover engaged thereover, the display component is protected from abrasion from swimmers, brushes, tools, pool sweepers, and any other potential damage from abrasion. Further, by making the top cover from a transparent plastic material which is inherently UV resistant, or by adding a UV blocker to the material or in a layer, UV from sunlight may virtually be eliminated from striking the surface of the display component and thereby provides a means to protect the display component from sunlight damage.

The device features a base that is operatively engaged through the surfacing material forming the pool or spa bottom. Above the base is engaged with a support tray that provides a path for water to enter the drain through apertures formed in a raised perimeter edge. The bottom side of the support tray faces the top of the base component. The top side of the support tray forms one sidewall of the display cavity.

Engaged above the support tray is the top component which has a top surface which is substantially transparent and forms the other sidewall defining the display cavity which houses the display component viewed through the transparent top surface. Apertures between fins formed on a sidewall of the top component provide passages for water to communicate through the support tray and into the aperture in the center of the base component. In a preferred mode of the device, deflectors also direct a flow of water across the display component to aid in the prevention of algae, dirt, or other buildup that might adhere to the display component.

The device is assembled from the various components through a registered engagement of the components with each other using means for registered engagement located about the outside perimeters of the components. This helps align the screw apertures in the planar top component with those formed in the support tray and receiving apertures in the base that threadably engage screws to hold the perimeter edges of the components in a compressed sandwiched engagement when the device is assembled.

Because the display component occupies the display cavity formed between the planar top and the support tray, instead of being adhered to the top surface it is easily changed during the lifespan of the device by simply disengaging the screws, removing the planar top, and changing the display component housed in the display cavity. Thus, should the pool or spa change colors, or should advertising or logos or photos or any other type of indicia or surface be desired for display through the transparent top surface, the user need only remove the planar top and replace the display component.

An object of this invention is to provide a drain cover for a pool or spa or fountain that is easily adapted to the color or texture of the surface surrounding the drain.

Another object of this invention is to provide a drain cover that employs a transparent top surface that protects the surface of the displayed component behind it.

An additional object of this invention is the provision of such a drain cover that renders the displayed component, and hence the color or look of the drain cover, easily changeable by the user without replacing the entire top cover component.

A still further object of this invention is the provision of such a drain cover that protects the displayed component that is viewed through the transparent top surface from sunlight.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE ASSOCIATED DRAWINGS

DETAILED DESCRIPTION OF PREFERRED EMBODIMENTS OF THE DISCLOSED DEVICE

Figure 1:
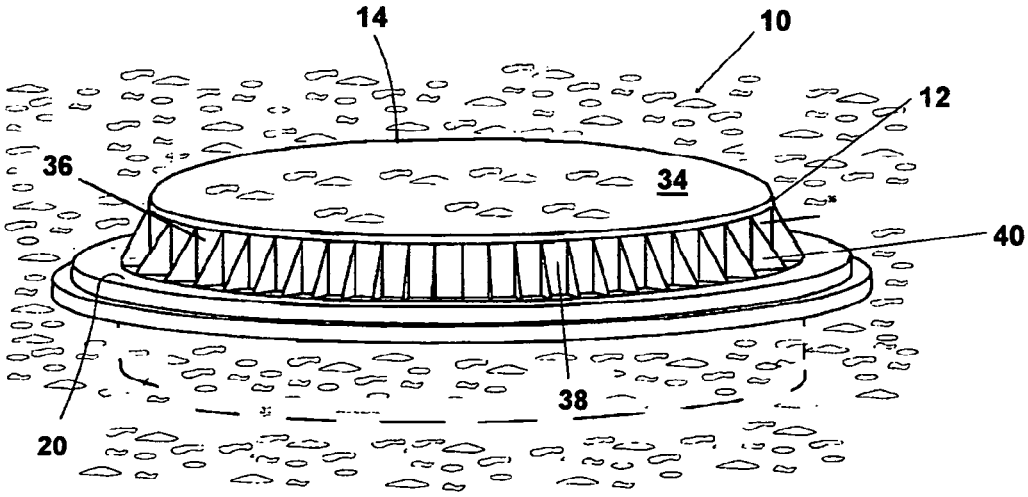
FIG. 1 is a perspective view of the drain cover device showing the assembled device with the base engaged in a drain aperture and the display component visible through the transparent top surface thereby blending the device into the surrounding surface.
Figure 3:
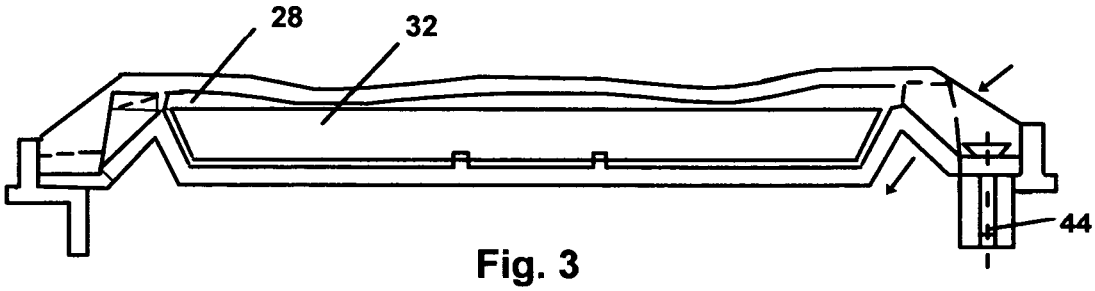
FIG. 3 is side view of the device showing a sectional view of the assembled device of FIG. 1.
Figure 4:
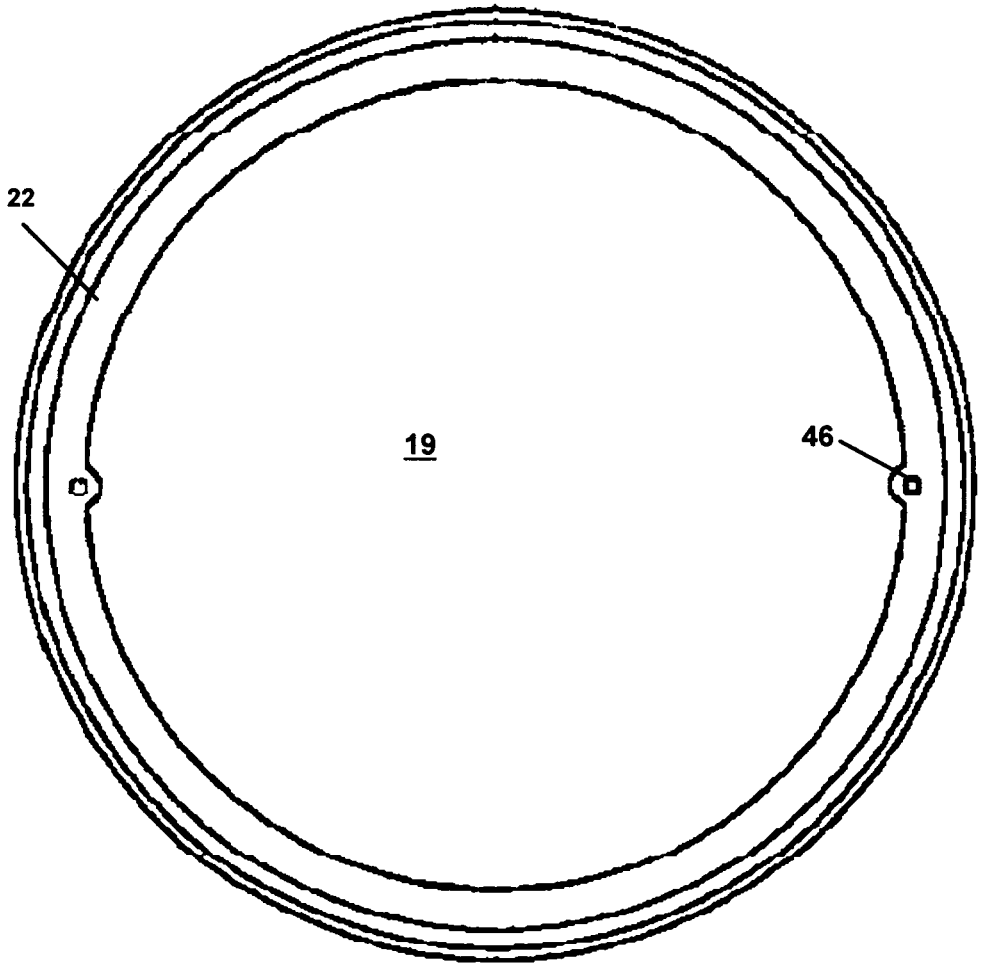
FIG. 4 depicts a top view of the base component showing the drain aperture surrounded by a sidewall and receiving cavities for threadable engagement with screws.
Figure 5:
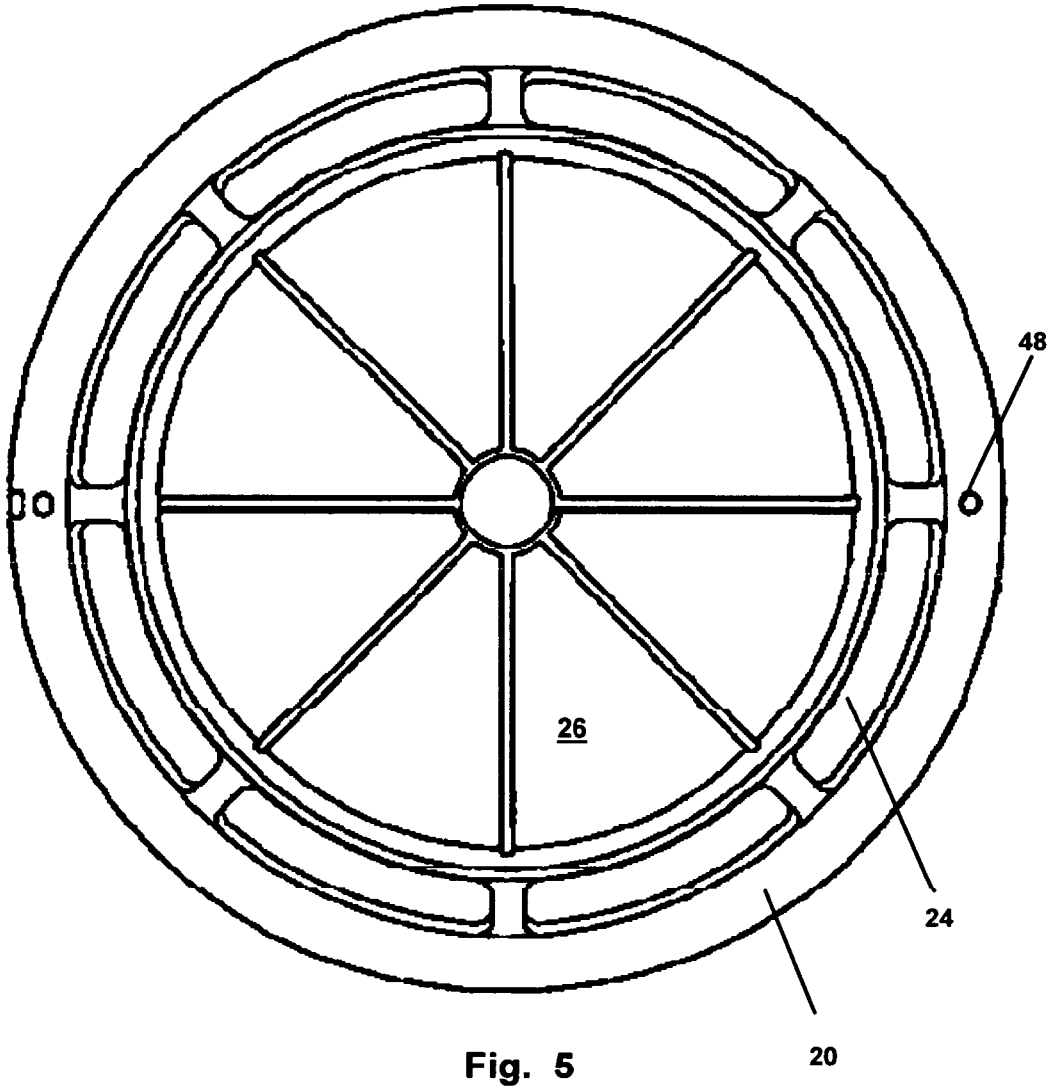
FIG. 5 is a top view of the support tray which serves to hold the display component that is viewed through the top surface.
Figure 6:
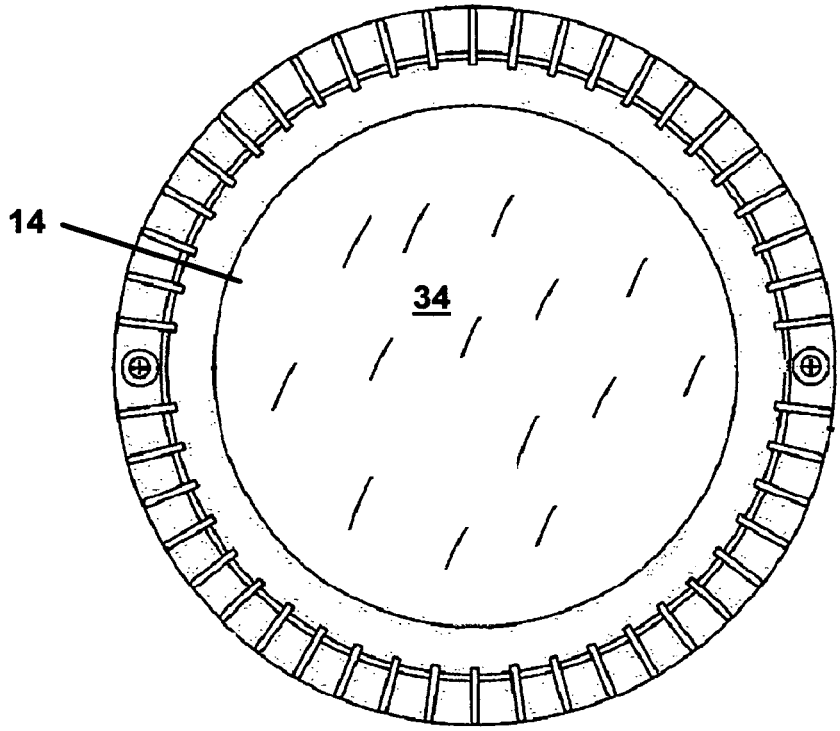
FIG. 6 shows a top view of the planar top component with fins projecting from the sidewall and the transparent top surface.
Figure 7:
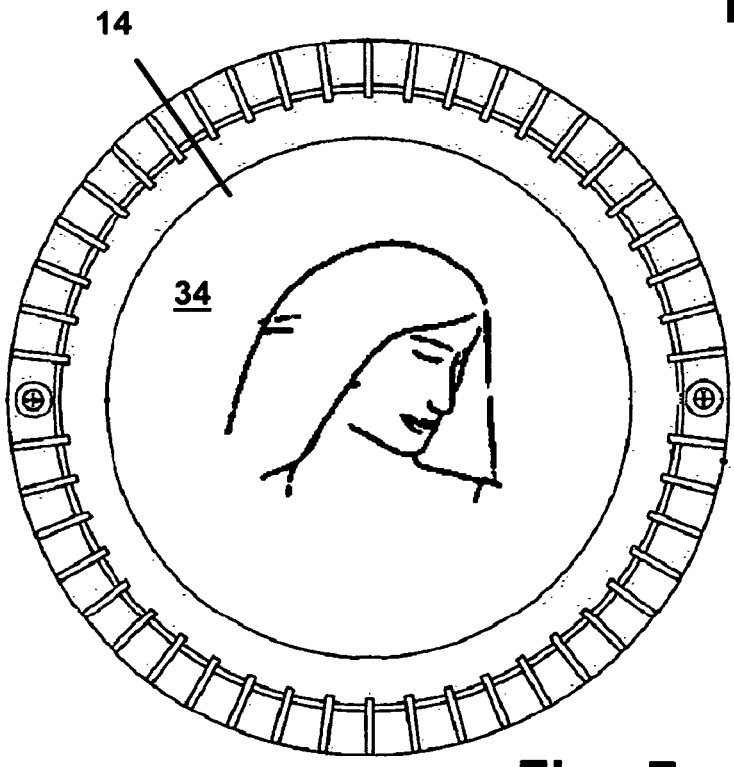
FIG. 7 shows a top view of the planar top component showing a logo housed in the display cavity and viewable through the transparent top surface.

Referring now to the drawings, FIGS. 1-7 disclose the preferred embodiments of the disclosed drain cover assembly device 10 for covering the drain openings of conventional pools, spas, fountains, ponds, and the like. The device 10 can be made to blend into the surrounding surface of the pool or spa as shown in FIG. 1, or can be made to act as a display for indicia or other matter such as a picture as shown in FIG. 7, which is viewable from above the water's surface.

As depicted in assembled and mounted in a surrounding surface in FIG. 1, the device 10 features a drain cover or top component 12 having a top surface 14 extending between a sidewall 16 around its periphery and defining the shape of the top component 12 and the top surface 14. As shown the device 10 has a circular shape which is common in many such drains, however it could be formed in other shapes such as rectangles and such is anticipated.

The device 10 when provided in new construction is assembled from a plurality of engaged components. A base 18 component is configured to be operatively mounted into the surface surrounding the drain aperture of the pool or spa. The base component 18 has a drain aperture 19 formed in its center section to communicate water to the underlying conduits under the surface material forming the pool or spa. In existing installations the base component 18 would already be installed and the drain aperture 19 would also be preexisting.

Generally, the surrounding surface material is cementitious and forms a waterproof seal with the exterior circumference of the base 18. Mounted above the base 18 is a support tray 20 which as shown is engaged about its circumference with the periphery of the base 18 inside a lip 22 portion of the sidewall 24 defining the shape and size of the base 18. However other engagement configurations could be used and are anticipated.

The support tray 20 has a double wall configuration of the sidewall 21 defining the shape of the support tray and formed about its perimeter. The outer portion of the double wall has a plurality of drain passages 24 through which water communicates into the drain aperture 19 of the base 18. The inner wall serves to support a center section 26 which serves as a bottom wall to the display cavity 28 formed between the center section 26 and the central section 34 of the top component 12 when the device 10 is assembled.

The center section 26 thus provides a means to support the display component 32 adjacent to the top surface 14 where it can be viewed therethrough the transparent or opaque material forming the top surface 14. Of course other means to support the display component 32 adjacent to the top surface 14 can be employed and such are anticipated so long as the drain aperture 19 is covered to disguise it by blending into the surrounding surface, or by other indica or printed matter or material forming the display component 32 that will cover over the drain aperture 19. In existing applications where the top component 12 is engaged over an existing drain aperture 19 the means for support of the display component 32 might engage into the aperture 19 or with the top component 12 itself or in some another fashion. Such an engagement to the top component 12 would best be water tight to avoid moisture problems and algae forming on the top surface of the top component 12. This would be accomplished currently by a threaded engagement 33 of the display component 32 directly to the underside of the top component 12 or perhaps with a tray that would engage the top component 12 and hold the display component in place. Or, surface or other material might even be adhered to the underside 29 of the top component 12 to thereby be viewed when it is attached over the drain aperture 19. Other means of supporting the display component adjacent to the underside of the top component 12 will be readily discernable to those skilled in the art; therefore, any means to support the display component adjacent to the underside of the substantially transparent center section 14 of the top component 12 is thus anticipated by this application.

Figure 2:
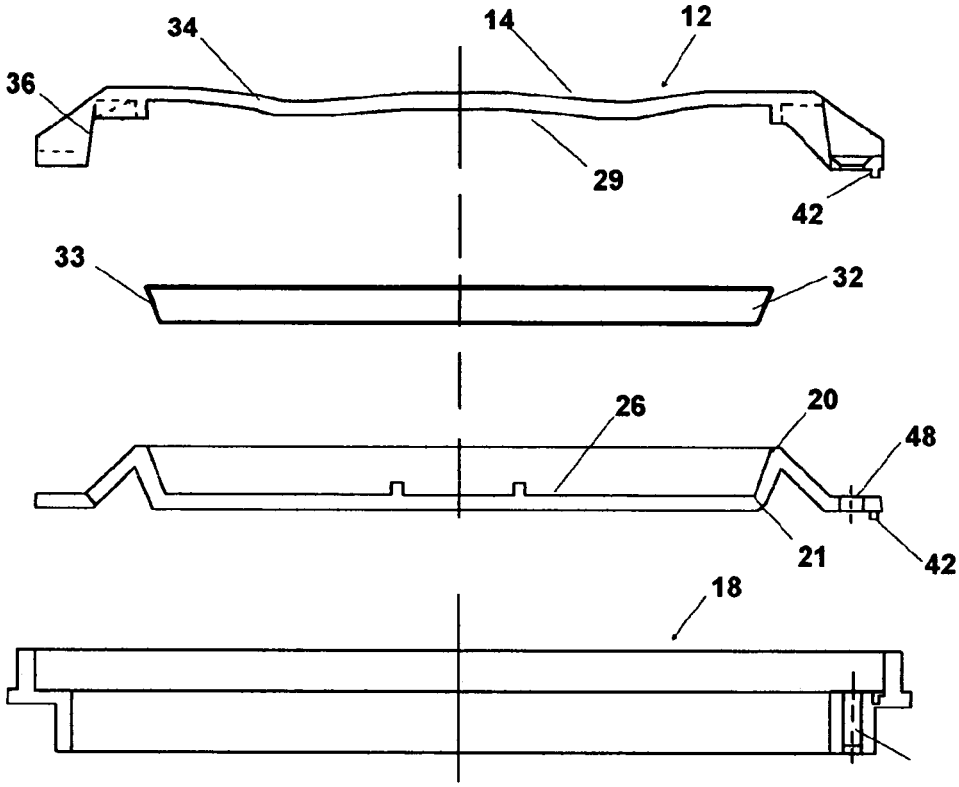
FIG. 2 depicts a side view of the device in an exploded view.

As disclosed in FIG. 2, the center section 26 can either be used as a means to support a display component 32 that is removably engaged in the display cavity 28 which is the same as the surrounding surface such as a tile or disk formed of surrounding surface material, or, a display component 32 of similar looking material. Alternatively, the center section 26 can be used to actually engage with a permanent adhesion of the surrounding surface material itself for a permanent mount of a display component 32 therein. If removably mounted through means to support the display component adjacent to the substantially transparent center section 14, the display component 32 is easily changed by removal from the display cavity 28 and replacement with another disk or printed or photographic or other display component 32. If permanently mounted by adhesion to the center section 26 of a support tray 20, the display component is still removable and replaceable by replacement of the support tray 20.

Placement of the display component 32 adjacent to and behind the top surface 14 allows for protection of the display component 32 from damage from swimmers, pool cleaning devices like brushes or vacuums, or the never-ending assault of sunlight. This is because it is protected inside of the display cavity 28 by the top component 12 but still easily viewable from above through the substantially transparent center section 34 of the top surface 14 of the top component 12 which protects the underlying display component 32. Further, it is envisioned that the top component 12 properly adapted for engagement to the underlying drain might simply be retrofitted to existing drains without the other intervening components. Consequently, the top component 12 could be provided without the other components to retrofit existing drains and provide the protected display cavity 28 to hold and display the contents therein.

In a preferred mode of the device, the center section 34 of the top component 12 has a undulating or curved surface 36 as best shown in FIG. 2. It has been found through experimentation, that while a flat or substantially planar transparent center section 34 will protect the underlying display component 32, that placing a dip in the center section 34 helps to relieve pressure from vacuum devices that might tend to stick to a flatter center section 34. Such a suction problem is relatively rare so a substantially planar center section 34 will work effectively; however, the provision of the curved surface 36 or some other means to prevent a suction device from adhering to the center section 34 is desirable.

As noted, the top component 12 is formed of a material which will provide a center section 34 that is substantially transparent. A top sidewall 36 elevates the center section 34 above the support tray 20 and thereby defines the dimensions of the display cavity 28. Top sidewall apertures 38 are formed in the top sidewall 36 and communicate with the passages 24 in the support tray 20 to pass water therethrough. Fins 40 may be also formed on the top sidewall 36 adjacent to the apertures 38. Through experimentation, it has been found that in a preferred mode of the device 10 a means for communication of water through the display cavity 28 is desirable. This is enabled by forming one or a plurality of the apertures 28 in the top sidewall 36 to communicate water over the support tray sidewall 21. This movement of fresh water through the display cavity 28 tends to prevent the formation of algae and helps prevent sentiment from entering the cavity over time by continuously flushing the display cavity 28.

As noted, the device 10 is operatively assembled by engaging the top component 12 with the base 18 and sandwiching the support tray or other means to support the display component 32 adjacent to the underside 29 of the substantially transparent center section, in-between. It is envisioned that the support tray 20 and base 18 might be a single component or the support tray 20 and top component 12 might be engageable to each other before engagement with the base 18 or over an underlying drain occurs. Any configuration and assembly that forms a display cavity 28 underneath the transparent center section 34 of the top component 12 and supports a display component therein and over the underlying drain is anticipated; however, the disclosed mode of components and assembly work well and are the current preferred embodiment of the device 10.

A registered engagement of the three components is desirable to allow for easy assembly and engagement of the top component 12 and support tray 20. Means for alignment such as pins 42 which engage properly positioned recesses are currently shown; however, other means for alignment of the components for final engagement are anticipated.

Means compressed engagement of the perimeter of the top component 12 to the perimeter of the base 18 are currently provided by screws 44 communicating through the top component 12 with receiving apertures 46 in the base 18. The support tray 20 is held in position sandwiched therebetween. If desired, passages 48 through the support tray 20 can be provided; however, any arrangement that holds the support tray 20 between the other two components is anticipated.

Finally, the device 10 herein could be employed in a method to provide a drain cover which blends into the surrounding pool or spa or other surface using a display component of the actual surface material during construction of the surface. In such a method, the user would take the top component 12 with its substantially transparent top surface 14 and employ a means to hold the surface material adjacent to the underside 29 of the top surface 14. This can include actually adhering the surface material directly to the underside 29 of the top surface 14 or placing such material in a tray or other component adapted to hold the material adjacent to the underside 29 of the top surface 14. Then the top component would be mounted over the drain aperture 19 thereby rendering the top component 12 substantially invisible when viewed from above or above the water's surface.

Although the invention has been described with respect to particular embodiments thereof, it should be realized that various changes and modifications may be made therein without departing from the spirit and scope of the invention. While the invention as shown in the drawings and described in detail herein discloses arrangements of elements of particular construction and configuration for illustrating preferred embodiments of structure and method of operation of the present invention, it is to be understood, however, that elements of different construction and configuration and other arrangements thereof, other than those illustrated and described, may be employed in accordance with the spirit of this invention. Any and all such changes, alternations and modifications as would occur to those skilled in the art are considered to be within the scope of this invention as broadly defined in the appended claims.

Further, the purpose of the attached abstract is to enable the U.S. Patent and Trademark Office and the public generally and especially the scientists, engineers and practitioners in the art who are not familiar with patent or legal terms or phraseology to determine quickly from a cursory inspection the nature and essence of the technical disclosure of the application. The abstract is neither intended to define the invention of the application which is measured by the claims, nor is it intended to be limiting as to the scope of the invention in any way.

What is claimed is:

1. A drain cover adapted for engagement above a water drain aperture in a pool surface comprising:

a drain cover having a perimeter edge, said drain cover adapted for engagement over said drain aperture in said pool surface;

said drain cover having a central wall having an upper surface, a lower surface, and a side wall of a predetermined thickness, wherein the upper and lower surfaces are contiguous with the side wall and the central wall is comprised of the same material;

a display component;

said central wall being sufficiently transparent to allow viewing of said display component therethrough; and means to support said display component adjacent to said lower surface in a display cavity defined by an area between said drain aperture and lower surface of said central wall, whereby said display component is viewable through said central wall from a viewing position above said upper surface and protected by said central wall.

2. The drain cover of claim 1 additionally comprising:

a sidewall, said sidewall having an upper edge communicating with said central wall and having a lower edge communicating with said perimeter edge; and a plurality of apertures formed in said sidewall to provide communication of said water from said pool with said drain aperture.

3. The drain cover of claim 2 additionally comprising:

a gap between said display component and said lower surface; and means to direct some of said water communicating through said plurality of apertures in said sidewall through said gap.

4. The drain cover of claim 3 wherein said means to support said display support component adjacent to said lower surface and between said drain aperture and said lower surface comprises:

a support tray;

said support tray adapted for engagement between said drain aperture and said lower surface; and said support tray having a center section adapted for engagement with a bottom surface of said display component; and said display component having an upper surface positioned adjacent to said lower surface and communicating with said gap.

5. The drain cover of claim 4 additionally comprising:

a base component, said base component adapted for engagement through said the surface of said pool; and said base component having a interior aperture defining said drain aperture.

6. The drain cover of claim 3 additionally comprising:

a base component, said base component adapted for engagement through said surface of said pool;

said base component having a interior aperture defining said drain aperture; and means for engagement of said drain cover to said base component.

7. The drain cover of claim 2 wherein said means to support said display component adjacent to said upper surface and between said drain aperture and said lower surface comprises:

a support tray; said support tray adapted for engagement between said drain aperture and said lower surface; and said support tray having a center section adapted for engagement with said display component.

8. The drain cover of claim 7 additionally comprising:

a base component, said base component adapted for engagement through said surface of said pool; and said base component having a interior aperture defining said drain aperture.

9. The drain cover of claim 2 additionally comprising:

a base component, said base component adapted for engagement through said surface of said pool;

said base component having a interior aperture drain cover to said base component.

10. The drain cover of claim 1 wherein said means to support said display component adjacent to said upper surface and between said drain aperture and said lower surface comprises:

a support tray;

said support tray adapted for engagement between said drain aperture and said lower surface; and said support tray having a center section adapted for engagement with said display component.

11. The drain cover of claim 10 additionally comprising:

a base component, said base component adapted for engagement through said surface of said pool;

said base component having a interior aperture defining said drain aperture; and means for engagement of said drain cover to said base component with said support tray therebetween between the drain cover and base component.

12. The drain cover of claim 10 additionally comprising:

said display component being formed of display material engaged in said center section of said support tray;

said display material being composed of the same material as that forming said pool surface; and whereby said display component viewed through said central wall from above said upper surface hides said drain aperture and blends into said pool surface surrounding said drain cover thereby rendering said drain cover substantially indiscernible from said pool surface surrounding said drain cover.

13. The drain cover of claim 10 additionally comprising: said upper surface of said central wall having a non-planar shape said non-planar shape-thereby providing a means to prevent sectional adhesion of a vacuum device thereto.

14. The drain cover of claim 1 additionally comprising:

a base component, said base component adapted for engagement through said surface of said pool;

said base component having a interior aperture defining said drain aperture; and means for engagement of said drain cover to said base component.

15. The drain cover of claim 1 wherein said display component is formed of display material, said display material being composed of the same material as that forming said pool surface; and whereby said display component viewed through said central wall from above said upper surface hides said drain aperture and blends into said pool surface surrounding said drain cover.

16. The drain cover of claim 1 wherein said display component is formed of a display surface, said display surface comprised of ink printed on a substantially planar print surface.

17. The drain cover of claim 16 wherein said display component is formed of display surface having indicia printed thereon.

18. The drain cover of claim 16 wherein said indicia is a logo.

19. The drain cover of claim 1 additionally comprising: said upper surface of said central wall having a non-planar shape said non-planar shape-thereby providing a means to prevent sectional adhesion of a vacuum device thereto.

* * * * *